United States Patent [19]

Reil

[11] Patent Number: 4,997,099

[45] Date of Patent: Mar. 5, 1991

[54] PACKAGING MEANS FOR FLUENT MATERIALS AND COMPRISING AN OPENING DEVICE

[75] Inventor: Wilhelm Reil, Bensheim, Fed. Rep. of Germany

[73] Assignee: Tetra Pak Holdings & Finance S.A., Pully, Switzerland

[21] Appl. No.: 429,677

[22] Filed: Oct. 31, 1989

[30] Foreign Application Priority Data

Nov. 4, 1988 [DE] Fed. Rep. of Germany ..... 3837495

[51] Int. Cl.[5] ..... B65D 47/36

[52] U.S. Cl. ..... 220/269; 220/307; 220/94 R; 220/339

[58] Field of Search ..... 220/94 A, 306, 307, 220/269, 220, 254, 330, 339

[56] References Cited

U.S. PATENT DOCUMENTS

| | | | |
|---|---|---|---|
| 3,268,112 | 8/1966 | La Croce | 220/306 X |
| 4,103,804 | 8/1978 | Fournier et al. | 220/307 X |
| 4,669,640 | 6/1987 | Ando et al. | 222/541 |
| 4,687,116 | 8/1987 | Dutt et al. | 220/269 X |

FOREIGN PATENT DOCUMENTS

| | | |
|---|---|---|
| 0075539 | 4/1985 | European Pat. Off. . |
| 0191525 | 8/1986 | European Pat. Off. . |
| 0251590 | 1/1988 | European Pat. Off. . |
| 144746 | 11/1980 | Fed. Rep. of Germany . |
| 3405253 | 8/1985 | Fed. Rep. of Germany . |
| 3640040 | 6/1987 | Fed. Rep. of Germany . |
| 426533 | 6/1967 | Switzerland . |

*Primary Examiner*—Steven M. Pollard

*Attorney, Agent, or Firm*—Biebel, French & Nauman

[57] ABSTRACT

A container for liquids comprises a tube at the upper end of which there is a lid consisting of thermoplastics synthetic material without any carrier material and which is injection molded along the top edge of the tube, forming a pouring means with a closure flap. The closure flap is captively articulated on the lid by means of an articulating axis, on the side opposite the tip of the pouring aperture, being adapted to be engaged on the lid in the open condition via an engaging means. In order that the closure flap can be kept open and can nevertheless be pressed down again into as far as possible a clearly defined position in order to reclose the container, the handle is connected via a curved articulating member to the middle portion of the lid. The curved articulating member is preferably provided on the surface of the lid alongside the engaging means.

6 Claims, 3 Drawing Sheets

PACKAGING MEANS FOR FLUENT MATERIALS AND COMPRISING AN OPENING DEVICE

BACKGROUND OF THE INVENTION

The invention relates to packaging for fluent contents, with a tube at the end of which there are a bottom and a top, of which the top consists of thermoplastics synthetic material without a carrier material, is injection molded onto and along the top edge of the tube and comprises a pouring device with a closure flap, the closure flap being captively articulated on the lid by means of a hinging axis on the side opposite the tip of the pouring orifice and/or is adapted to be clipped onto the lid via an engaging means, while the lid is opened.

Countless packaging means are already known which comprise a tube consisting of plastics coated paper, the lid of which is injection molded and consists of thermoplastics material, carrying an injection molded opening device at the same time. Packaging means have a ready been devised which have a rectangular bottom and a round top or also a round top and a round bottom or also a rectangular top and a rectangular bottom. Notwithstanding the shape of the packaging means, in the case of the present invention what is important is the configuration of the opening device. This must permit of satisfactory stacking, must be sealing tight during transport and storage and must at the same time be capable of being easily opened by the end user without the application of excessive force.

Prior art opening devices of this type comprise a closure flap in the region of a pouring orifice with a handle connected to the closure flap by a pull web. To open the container, the user takes hold of the handle and by means of the pull web pulls the closure flap upwards along a line of weakness, so that the closure flap exposes the aperture and it becomes possible to pour out the contents.

Opening devices are known in which the closure flaps are capable of being torn off completely, which has the disadvantage that they can be lost. Also, it has already been considered to retain closure flaps via a strip, but then it is often difficult to introduce it properly into the torn-open pouring orifice, at least, it will scarcely guarantee proper engagement for satisfactory reclosure.

Furthermore, during production it has been found that constructing the lid from a thermoplastics synthetic material without a carrier material is either time-consuming, material-consuming or is subject to fault, because it has been difficult to achieve a flow of material into the marginal zones of the lid while at the same time keeping the closure flap and such like clean.

SUMMARY OF THE INVENTION

The invention is based on the problem of providing conventional packaging means with improved opening devices which can on the one hand be opened more easily, the closure flap preferably being intended to be kept open, so that it can nevertheless, in order to be reclosed, be pushed down again into the opening in as far as possible a clearly defined position, the arrangement guaranteeing the manufacturer economy in production.

According to the invention, this problem is resolved in that the handle is connected to the middle portion of the lid by a curved articulating member. In order to open the pouring device the user pulls the closure flap upwards so that initially and advantageously the closure flap remains captively articulated on the lid via engaging means, because the closure flap is captively connected to the handle and this latter is connected to the lid by means of the curved articulating member.

Attaching the handle and therefore also the curved articulating member to the middle portion of the lid means that the anchoring point for the curved articulating member is disposed virtually alongside the closure flap engaging means.

Thus, the manufacturer is offered an economically produced item, because the curved articulating member can at the same time be used as a channel for the flowing synthetic plastics material with which the lid and its opening device is molded. The synthetic plastics material is then introduced through the middle of the lid, i. e., outwardly from the middle portion, so that—as is well known—the molded product is improved, because all the radial flow paths are of virtually the same length from the middle outward.

According to the invention, it is expedient for this if the curved articulating member is mounted on the surface of the lid alongside the engaging means. Although the curved articulating member thus protects from the surface of the lid by a small amount, the stackability of the liquids container is not adversely affected thereby. The curved articulating member may take the form of a strip and may be fitted to the level of the lid after the lid has been injection molded and while it is still in the plastic state. This in turn provides a flat lid with an opening device, handle and curved articulating member, in which substantially no parts are provided which project beyond the outer contours, i. e., beyond the plane of the lid. Thus, one container can be stacked on the others.

In a further advantageous development of the invention, the engaging means comprise, mounted in the middle portion of the lid, a nose which is connected to the curved articulating member via a connecting web. By providing such an engaging means, the closure flap can be fitted into the lid while open and can be kept open. This facilitates handling and pouring with the package. Opening, too, is particularly facilitated by the connecting web, because when the handle is pulled up and when the curved articulating member is bent upwardly, the nose is raised so that the engaging bead on the engaging means can be passed behind the nose with which it becomes engaged and in which it can be held. The engaging bead lies in the outer or upper plane of the closure flap and projects bead-like somewhat beyond it. At a distance from the engaging bead provided on the closure flap, in fact towards the middle portion of the lid, there is a rear wall which separates a sunken portion of the lid in which the opening device is provided from a raised part which forms the surface of the lid on which the curved articulating member is mounted. The aforesaid nose is provided on this rear wall, possibly via a reinforcing rib, and consequently it is at a distance from the closure flap. As the user pulls the closure flap upwards about the articulating axis, the engaging bead engages below the engaging hook of the nose, because the nose is pulled up by the connecting web and together with the curved articulating member. Thus, the closure flap is moved into and is engaged in the open position.

In the case of a further development of the invention, a projection is integrally molded at the top and rear of the ring-shaped handle. This is not by any means necessary and in many embodiments it is not even desirable, which is why to a certain extent tools are provided to avoid this projection remaining on the handle. On the other hand, such projections do not interfere with either the appearance or the operation and characteristically show how the synthetic plastics material is supplied via this projection during manufacture of the packaging means.

If one can imagine the molding tool, then the channel in the region of the projection represents the single flow-in passage for synthetic plastics material for forming the lid. When the lid is produced, in other words when the ring-shaped grip or handle is being formed, the heated thermoplastics material flows over the projection, i. e., from above and behind and towards both sides thereof (front and rear), so that a major part of the synthetic plastics material flows through the curved articulating member into the middle portion of the lid and thence radially over the flow paths to the edge while from the aforesaid projection a further portion of the liquid synthetic plastics material flows forwards over a pull strip and into the region of the opening device because somewhat more synthetic plastics material is required to produce this than is needed for the smooth walls of the lid. Both the pull strip between the handle and the closure flap at the front and also the curved articulating member between the handle and the middle portion of the lid at the rear constitute flow channels and, upon completion of the injection molding process and after removal of the lid from the mould, together with the opening device, they serve at the same time for correctly opening, holding, bending and reclosing the opening device.

Further advantages, features and possible applications of the present invention will emerge from the ensuing description of a preferred example of embodiment, in conjunction with the accompanying drawings in which:

BRIEF DESCRIPTION OF ACCOMPANYING DRAWINGS

DESCRIPTION OF THE PREFERRED EMBODIMENT

Figure 1:
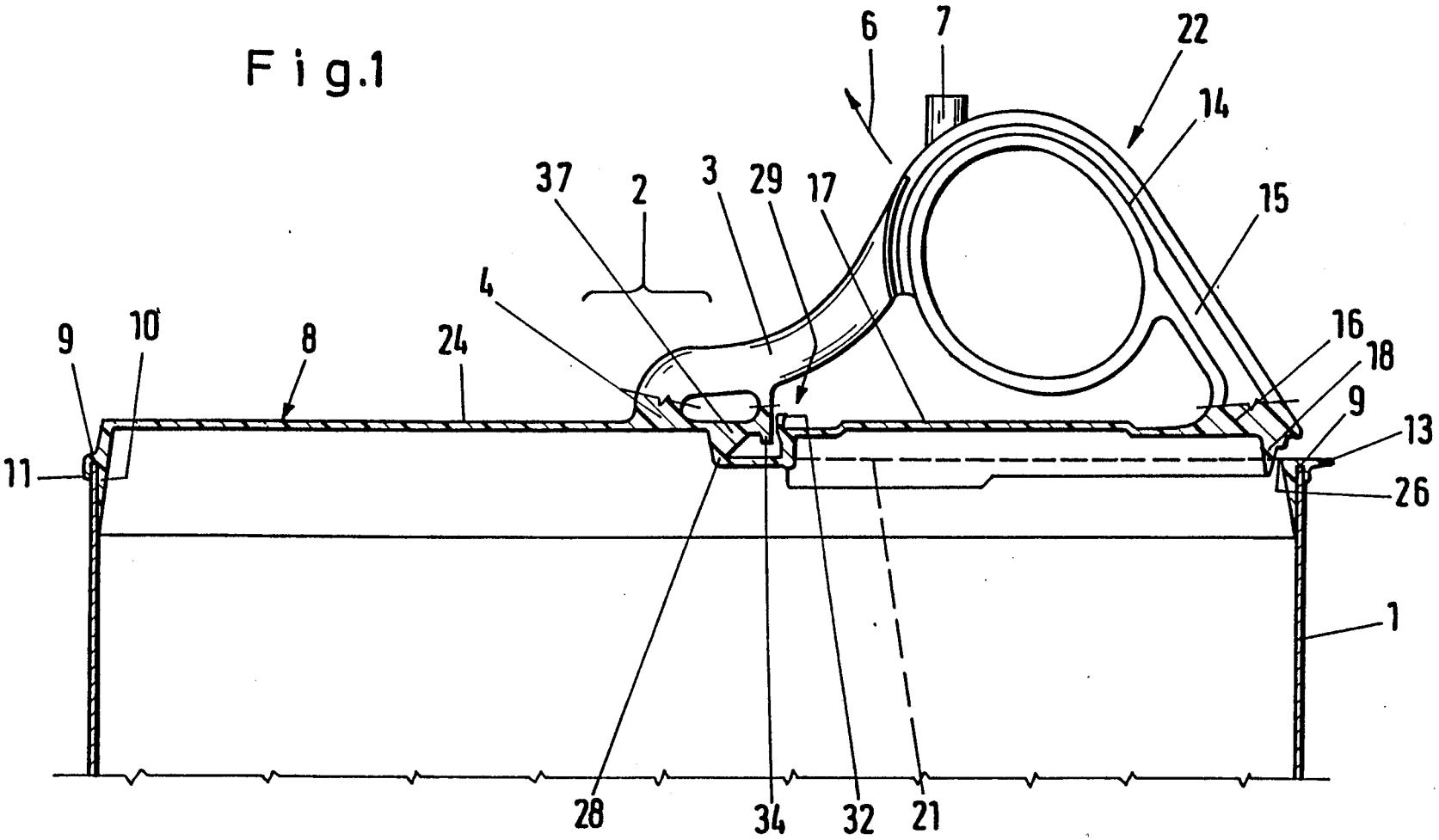
FIG. 1 is a cross-sectional view through the lid of a packaging means with an opening device and a handle, the broken-away view showing only that part of the handle, its pull strip and its curved articulating member which is disposed in the region of the lid.

Injection molded along the top edge 9 of the tube 1 is the lid 8 which consists of synthetic plastics material without a carrier material and comprising the pouring means generally designated 22 and with the closure flap 17. On the side opposite the tip 26 of the pouring aperture 27 which is located within a line of weakness 21, the closure flap 17 is captively articulated by means of an articulating axis 28. The closure flap 17 can be engaged on the lid 8 while open by means of the engaging device generally designated 29.

As FIG. 1 shows, the free top edge 9 which is firstly exposed by the cut, without plastics material, is completely enclosed by injected thermoplastics material of the lid 8, in fact on the inside of the tube 1 it is covered by a conically extending shoulder 10 and on the outside by a protective rim 11. When the packaging means has been completed, therefore, liquid cannot penetrate the plastics-free top edge 9 from any side and so cannot destroy it by swelling.

Figure 3:
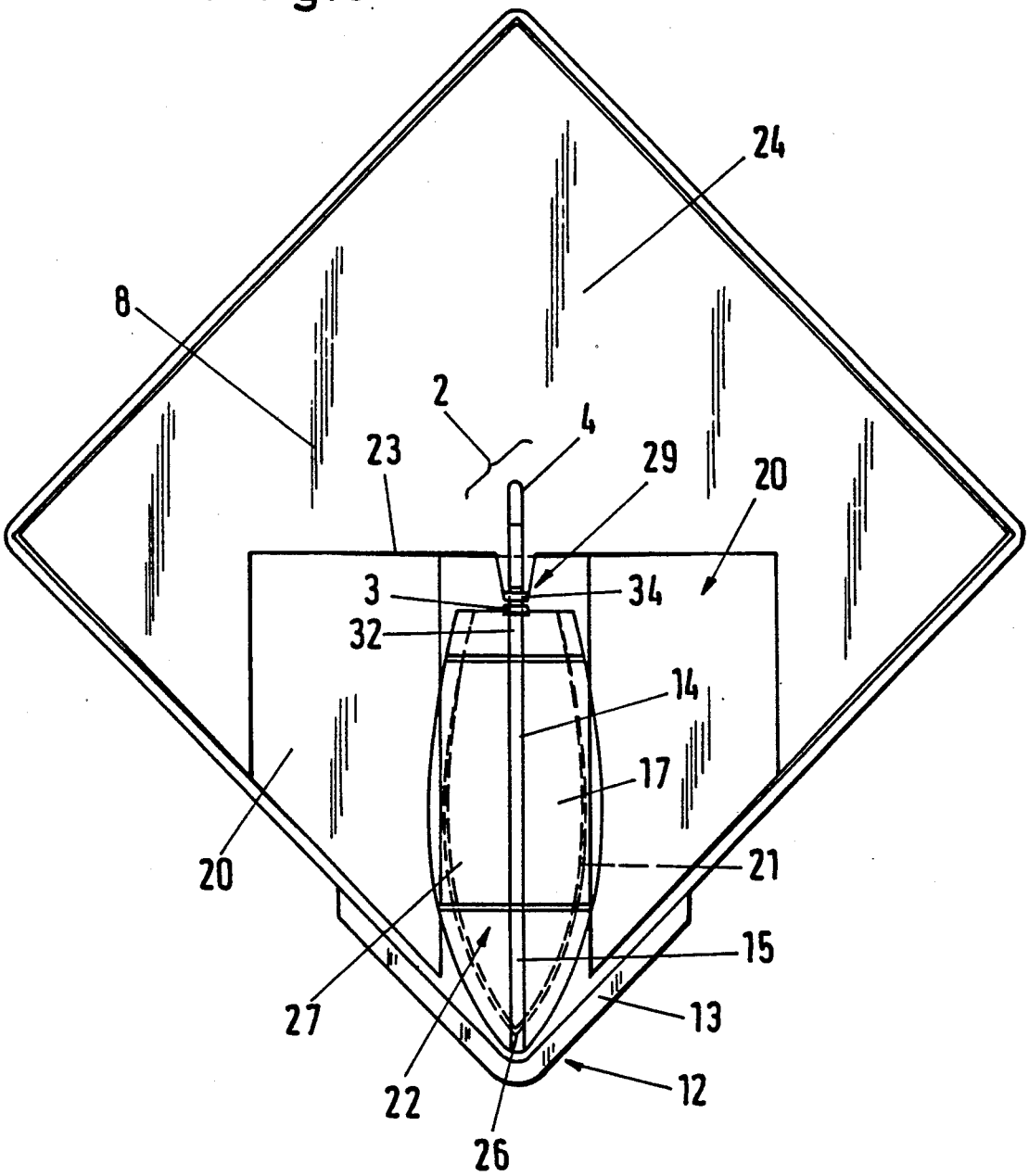
FIG. 3 is a plan view of the rectangular lid of the preferred embodiment.

The lid 8 which is injection molded on the top edge 9 of the tube 1 in this way has, when viewed in plan, four corners as can be seen clearly in FIG. 3, a pouring edge 13 which completely encircles the corner 12 being injection molded into the (here referred to as) "front" corner 12. From the outside, one can clearly see the handle 14 with the pull web 15 integrally molded on the tip 16 of the closure flap 17 at the front, close to the corner 12 of the lid. The closure flap is injection molded via a shoulder 18 into a depression 20 extending along the line of weakness 21.

According to the plan view in FIG. 3, the depression 20 is disposed in the bottom or front portion together with the pouring device 22, while above or behind the rear wall 23 there is the outer or upper wall portion 24 of the lid 8. FIG. 3 shows that the larger area of the lid 8 is occupied by the upper wall portion 24 which, when the handle 14 is folded over, serves as a supporting surface for the container which is immediately above it in the stack, during storage or during transport. On the side opposite the tip 26 of the pouring aperture 27, namely at the ends of the line of weakness 21, there is the afore-described articulating axis 28 with the engaging means 29. This latter is disposed in the region of the rear wall 23, at the transition from the surface of the lid 8 or from its upper wall portion 24 to the depression 20. The articulating axis 28 is only as wide as the distance between the lines of weakness 21 which end at the rear on the middle portion of the lid 8, in other words about 8 mm in the case of a one liter milk container.

Integrally molded on the upper rear edge of the closure flap 17, in the form of a deadhead, there is an engaging bead 32 and on the side of this which is towards the closure flap 17 there is a small shoulder. At a minimal horizontal distance from the middle portion 2 of the lid 8 there is a nose 34 which points downwardly and which is able to engage the shoulder of the engaging bead 32. A reinforcing rib 37 braces the nose 34 against the rear wall 23 and reinforces the nose which is disposed to project from the rear wall 23 towards the closure flap 17.

Figure 2:
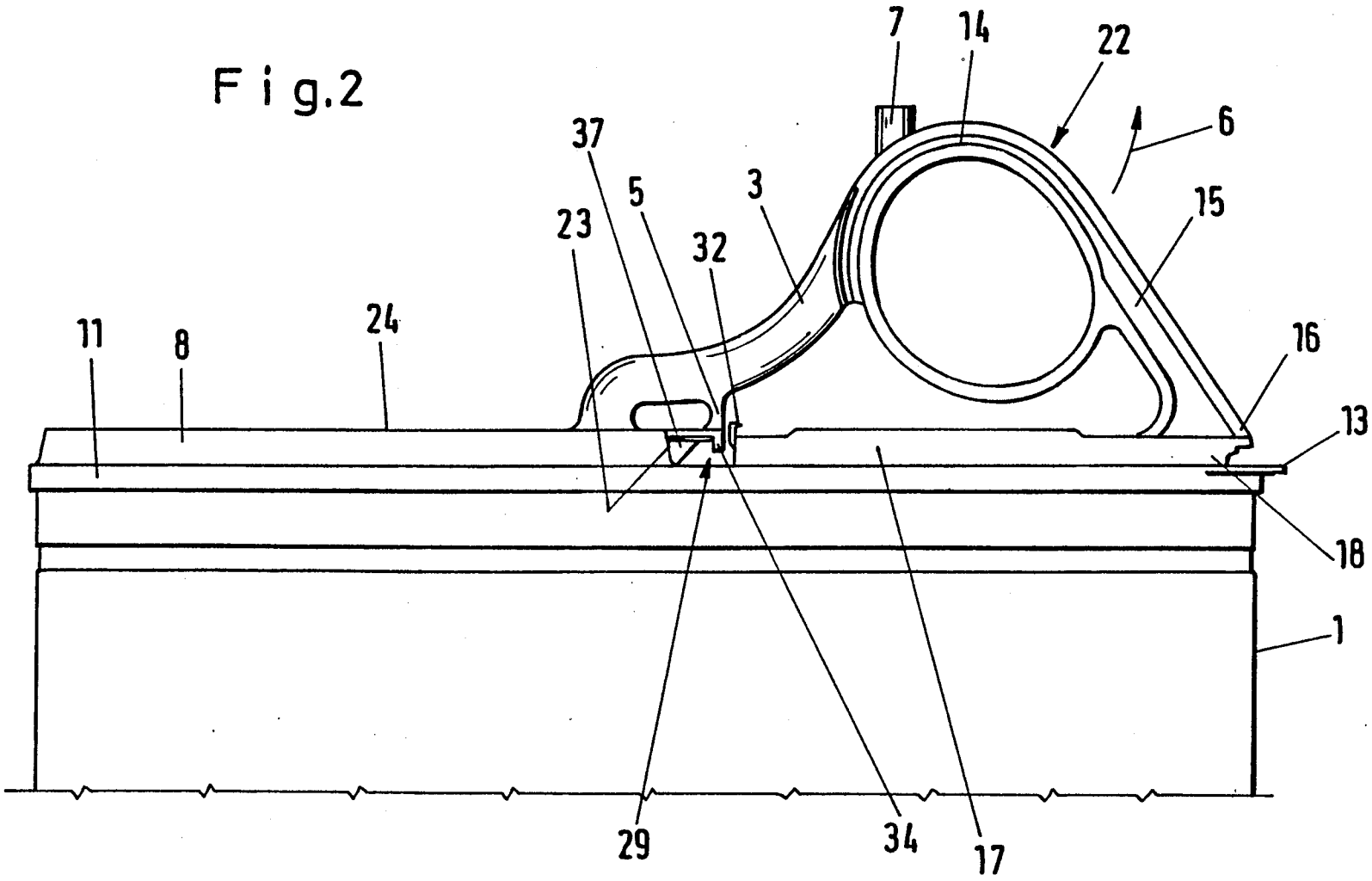
FIG. 2 is a front view of the top of the packaging means with the lid, the tube being broken away.

On the side of the annular handle 14 which is opposite the front of the tip 26, there is formed on the handle 14 a curved articulating member 3 which may be web-shaped like the pull web 15 but which in the side view in FIGS. 1 and 2 is shown to be curved being connected at the rear end (on the left in FIGS. 1 and 2) to the middle portion 2 of the id 8 at 4, via the upper wall portion thereof.

The curved articulating member 3 is connected to the nose 34 via a connecting web 5 so that as the handle 14 is pulled up in the direction of the arrow 6, the nose 34 is likewise bent upwardly in the direction of the arrow 6, forming a deformation of the strengthening rib 37.

At the top rear, the handle 14 is finally provided also with a projection 7 which is integrally molded with the pouring device 22 when the lid 8 is injection molded, because this projection 7 serves as a through-flow or feed of fluid synthetic plastics material from the injection mould into the cavities in order to form the lid with the pouring means 22.

In operation, after the pouring means 22 has been torn open and when the pouring aperture 27 is exposed, the engaging means 29 operates in such a way that the closure flap 17 is pivoted about the axis of articulation 28, in the direction of the arrow 6, the nose 34 being pulled upwards by the connecting web 5, the shoulder on the engaging bead thus being capable of engaging behind the nose 34. Thus, the closure flap with the somewhat deformed handle 14 mounted thereon, together with the pull web 15 and the curved articulating member 3, is locked in the open position.

Since all parts consist of thermoplastics material, it will be understood that in order to reclose the container, the user only has to exert a slight finger pressure on the closure flap 17 or the handle 14 in order to disengage the engaging bead 32 from its engagement with the nose 34 and the closure flap 17 can be pressed back again into the contours of the opening 27.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. A package for fluent materials, the package comprising:

a tubular container having a closed and sealed lower end and an upper end having an upper edge;

a closure lid molded to said upper edge, said lid comprising an upper cover surface, and an outer rim section molded over said upper edge;

pouring means comprising a pouring aperture and a closure flap which is snap latchable with said closure lid to seal said pouring aperture, said pouring means further comprising a gripping member including a curved articulating arm curved towards said upper closure lid and integrally connected thereto via a first web of material, at a position proximate to the center of said lid, said gripping member further comprising a second web of material integrally connected to said closure flap adjacent to a rear edge of said closure flap, said gripping member being rotatable relative to said closure lid about an articulation axis proximate to said first web, and intermediate said first web and said second web; and engaging means adapted for retaining said closure flap in an open position upon rotation of said closure flap.

2. The package of claim 1, wherein said engaging means comprises a nose portion integrally connected to said curved articulating arm forward of said articulating axis, and further comprises an engaging bead extending upwardly from said closure flap, the articulation of said articulating arm causing said nose to be lifted and said engaging bead to be rotated under said engaging bead, thereby retaining said closure flap in an open position.

3. The package of claim 1, wherein said closure flap resides in a depression below an upper surface of said closure lid, the intersection of said depression and said upper surface defining a rear wall.

4. The package of claim 3, wherein said articulation axis is defined by a reinforcing rib located at said rear wall, said reinforcing rib being adapted to deflect upon rotation of said closure flap.

5. The package of claim 4, wherein a connecting web extends integrally downwardly from said articulating arm interconnecting said nose to said articulating arm.

6. The package of claim 1, wherein said gripping member is sideways collapsible about said first and second webs to allow a plurality of packages to be stackable one upon the other.

* * * * *